US008920101B2

(12) United States Patent
Leyco et al.

(10) Patent No.: US 8,920,101 B2
(45) Date of Patent: Dec. 30, 2014

(54) TENNIS BALL COLLECTION DEVICE

(75) Inventors: Reynaldo P. Leyco, Chester, VA (US); Steve L. Lawhorne, Charlottesville, VA (US)

(73) Assignee: Luck Stone Corporation, Richmond, VA (US)

( * ) Notice: Subject to any disclaimer, the term of this patent is extended or adjusted under 35 U.S.C. 154(b) by 689 days.

(21) Appl. No.: 13/232,553

(22) Filed: Sep. 14, 2011

(65) Prior Publication Data

US 2013/0064631 A1 Mar. 14, 2013

(51) Int. Cl.
*B60P 1/00* (2006.01)
*A63B 47/02* (2006.01)

(52) U.S. Cl.
CPC ..... *A63B 47/021* (2013.01); *A63B 2243/0083* (2013.01)
USPC ..... 414/439; 414/440; 414/441; 294/19.2

(58) Field of Classification Search
CPC ... A63B 47/021; A63B 47/024; A63B 47/025
USPC ..... 414/439, 440, 441; 294/19.2
See application file for complete search history.

(56) References Cited

U.S. PATENT DOCUMENTS 4,116,192 A 9/1978 Scott
4,735,544 A * 4/1988 Stotts ..... 414/440
5,301,991 A * 4/1994 Chen et al. ..... 294/19.2

OTHER PUBLICATIONS

"The Playmate Mower", printout from website: http://www.playmatetennis.com/mower.htm, Oct. 1, 2011, and accompanying pictures (8 pages).

* cited by examiner

*Primary Examiner* — Saul Rodriguez
*Assistant Examiner* — Willie Berry, Jr.
(74) *Attorney, Agent, or Firm* — Thomas, Karceski & Karmilovich, P.C.

(57) ABSTRACT

A tennis ball collection device includes a rotating drum that rotates at a higher speed than the rotation of the wheels that carry the device. Additionally, the drum rail that operates in connection with the rotating drum to lift a ball off of a ground is allowed to move in the horizontal direction. This back and forth movement is facilitated by a spring that otherwise biases the drum rail forward to a rest position.

15 Claims, 6 Drawing Sheets

TENNIS BALL COLLECTION DEVICE

The present invention is directed to an apparatus used to pick up tennis balls from the ground. Specifically, the apparatus is a push cart that includes a pick-up assembly mounted on it to easily allow a player/coach/instructor to collect and pick up loose tennis balls from the ground.

BACKGROUND

As any tennis player knows, it can be a nuisance to bend over and pick up stray tennis balls from a court surface or surrounding area. This is especially true for players, coaches and instructors who use a large number of balls with one or more players during a practice session. Often, dozens of balls will be lying on the court as a basket of balls is used to practice repetitive strokes or shots.

It is possible to pick up the balls manually by hand or by using a basket having a spaced-apart wire bottom adapted to lift the balls off the ground if pressure is pushed down on the basket. Additionally, there is a mechanical cart that is known to lift the balls off the court surface, but it is easily jammed if there are too many balls.

SUMMARY

Accordingly, it is an object of the present invention to overcome the foregoing drawbacks and provide a pick-up assembly that can easily collect multiple balls lying on a court surface.

DETAILED DESCRIPTION

The ball pick-up device described herein includes a high-speed, spinning drum and a spring-biased drum rail. Each of these features alone and, in one example, in combination makes the ball pick-up device more efficient and effective. Specifically, the high-speed drum enables the rapid pick up and collection of the balls. The spring-biased drum rail reduces or eliminates the jamming of the pick-up device during use, especially when collecting a large number of balls on the ground.

In operation, the ball pick-up device rolls over a tennis ball or balls on a court or flat surface. A spinning drum spins in the same direction as the wheels on the cart. It is mounted on the cart so that the bottom of the spinning drum is above the surface at a height of about equal to the diameter of a tennis ball. The leading edge of the drum rail then contacts the ball and lifts the ball into contact with the spinning drum. The ball is then drawn by rotation of the drum and friction between the ball and the curved surface of the drum rail up and around the drum where the ball is then dispensed and falls into a ball basket.

Existing commercial collection devices employ a drum connected to and that rotates at a 1:1 speed of the cart wheels of those devices. Also, the drum rail is fixed and immovable relative to the rotating drum. These prior devices are slow, because the speed of the drum is limited by the speed of the cart wheels. Since the cart wheels are generally large circumference, typically more than about eight or ten inches, the drum rotates slowly. These prior devices will also jam easily when multiple balls are being picked up. It is believed that the balls become wedged between the drum and the rail when they rub up next to each other as they are being rotated around between the drum and rail.

By driving the drum with a pulley system, or alternatively a gear or sprocket system, the drum described herein rotates substantially faster than the wheels of the cart. Also, the spring mount of the drum rail allows some flex in the rail so that the balls that are being picked up have space to become unbound if many balls are being picked up together and they otherwise press against each other.

We turn now to an example of a ball pick-up device as illustrated in the attached drawings.

Figure 1A:
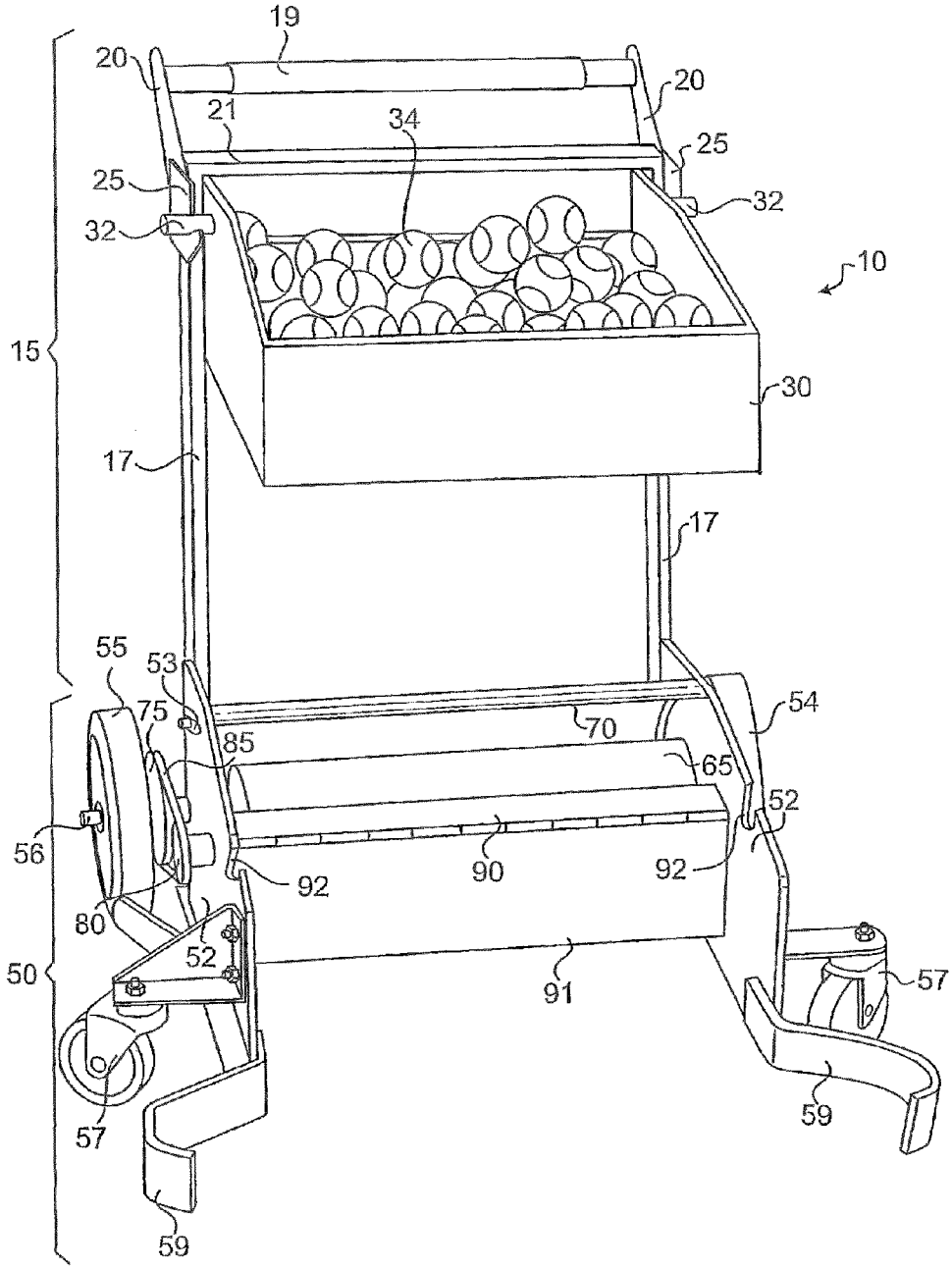
FIGS. 1A and 1B are perspective views of a ball collection device in accordance an example of the present invention wherein the ball basket is shown in the raised mounted position (FIG. 1A) and lower collection position (FIG. 1B).
Figure 1B:
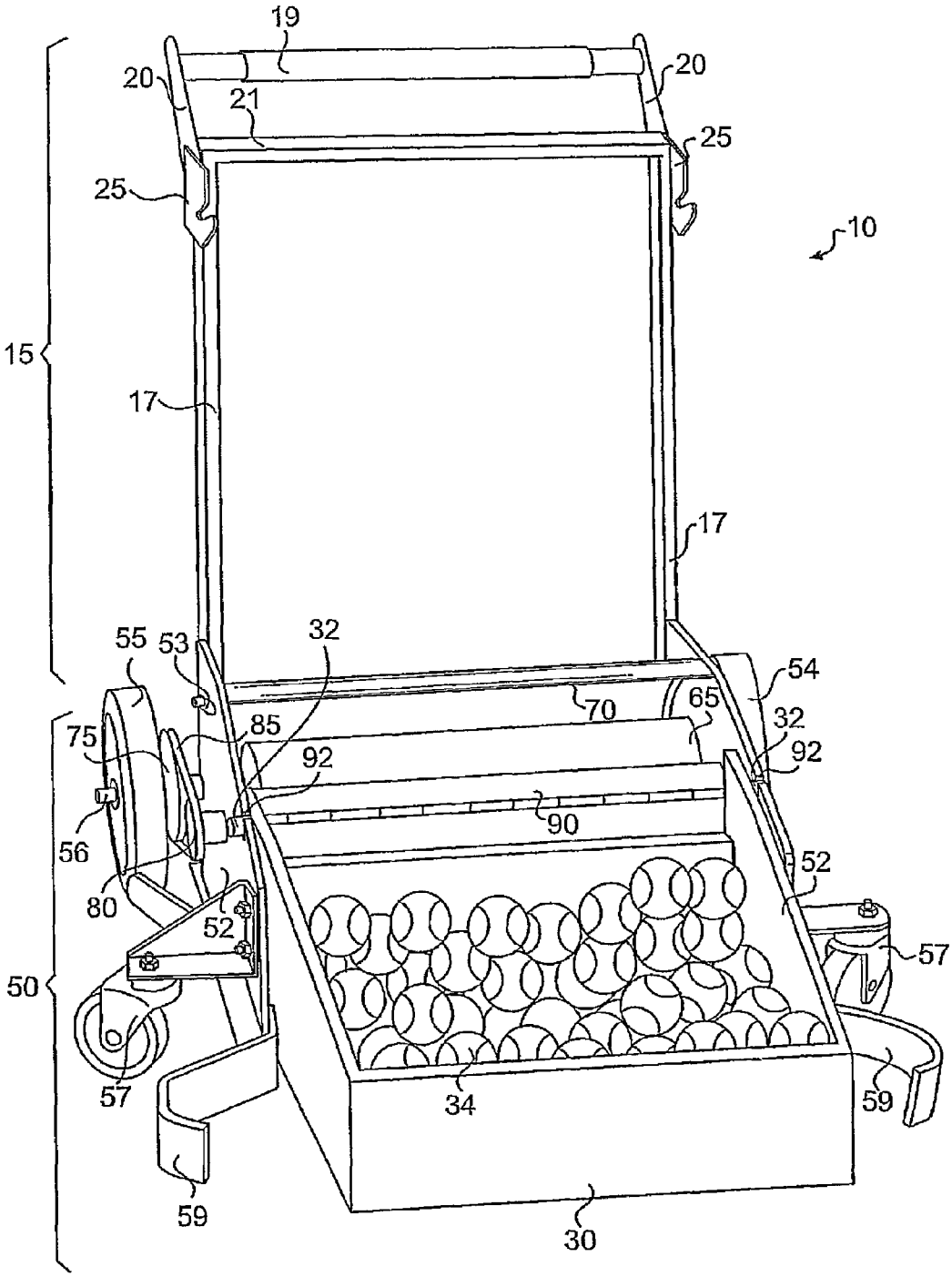

FIGS. 1A and 1B illustrate the alternative mounting locations of a ball basket 30 on the ball pick-up device 10. In FIG. 1A, the ball basket 30 is mounted on the handle portion 15 of the device 10. The ball basket 30 includes mounting pins 32 that fit into hooks 25 fixed to the top of the handle portion 15, and specifically to the top of the vertical rods 17. Alternatively, in FIG. 1B, the ball basket 30 is mounted in the collection position, using the mounting pins 32, that fit into the hooks or notches 92 on the base portion 50 of the cart 10. As is evident from these drawings, the ball basket 30 maybe very conveniently moved by a user back and forth from the raised position, FIG. 1A to the collection position, FIG. 1B.

All of the FIG. 1A through FIG. 5 include like-numbered components that illustrate and emphasize the same parts of an example of the pick-up device as described herein. Accordingly, the description herein refers to the parts consistently throughout.

Referring first to FIGS. 1A and 1B, the ball pick-up device 10 includes a cart portion 50 and handle portion 15. The handle portion 15 includes two upwardly standing rods 17 that are connected at their top end by a cross bar 21. At the top end of the rods 17 there is attached a handle arm 20 on each end that is connected across by a handle bar 19. The handle portion 15 also includes hangers 25 that comprise hooks. It is into these hooks of the hangers 25 that the tennis ball basket 34, and specifically its support pins 32 can be supported and held at the top of the ball collecting device 10.

The base portion 50 of the cart 10 includes four wheels. The front wheels 57 are swivel wheels. This allows free steering of the device. The rear wheels 54 and 55 are fixed rotation wheels. In other words, they rotate freely, but they only rotate around the single axis 56 by which they are attached to the base portion 50. Rear wheel 55 also has a pulley wheel 75 mounted on the same axis 56. A pulley configuration could likewise be mounted on wheel 54. It does not functionally matter which side the pulley assembly is mounted on the base 50 of the device 10. The common axis 56 means that the wheel 55 and the rear pulley wheel 75 will rotate on a 1:1 basis together. The base portion 50 includes as its sides a pair of sturdy side brackets 52 onto which all of the wheels 54, 55 and 57 are mounted. The bracket 52 further has a second pulley wheel 80 rotatably mounted to it. This second pulley wheel 80 is connected to a spinning drum 65 mounted horizontally across the base portion 50. The forward pulley wheel 80 is smaller in circumference than the pulley wheel 75. A belt 85 is operatively mounted to and within the pulleys 75 and 80. Accordingly, when the device 10 is moved along a surface, the rotation of the wheel 55 causes the rotation of the pulley wheel 75 which, through the belt 85, causes the forward pulley wheel 80 to rotate in the same direction as the wheel 55. This forward pulley wheel 80 is connected to the drum 65. Accordingly, the movement of the device 10 causes the rotation of the drum 65. It is preferred in one example that a belt tensioner bracket (not shown) is mounted on the side support bracket 52. The belt tensioner includes a nylon roller and allows a user to adjust the tension on the belt 85 to create some tension and enable or improve the drive of the drum pulley wheel 80 by the wheel pulley 75.

Also mounted across the base portion 50 and between the support side brackets 52 there is a drum rail 70. The drum rail 70 is a rigid curved sheet that tracks a circumference that corresponds to and is spaced evenly apart from the circumference of the drum 65. The drum rail 70 is slidably connected to the side brackets 52 by way of pins 73 slidably mounted in the slots 53 in the side brackets. The drum rail 70 is allowed to move back and forth in the horizontal direction within slots 53.

The side support brackets 52 further include notches 92 that are adapted to receive the pins 32 of the ball basket 30. The side wall brackets 52 further include guide arms 59 that cast a wide swath when collecting loose balls 34 on a surface as well as protect and deflect balls from being run over by the rear wheels 55 in operation.

Figure 2:
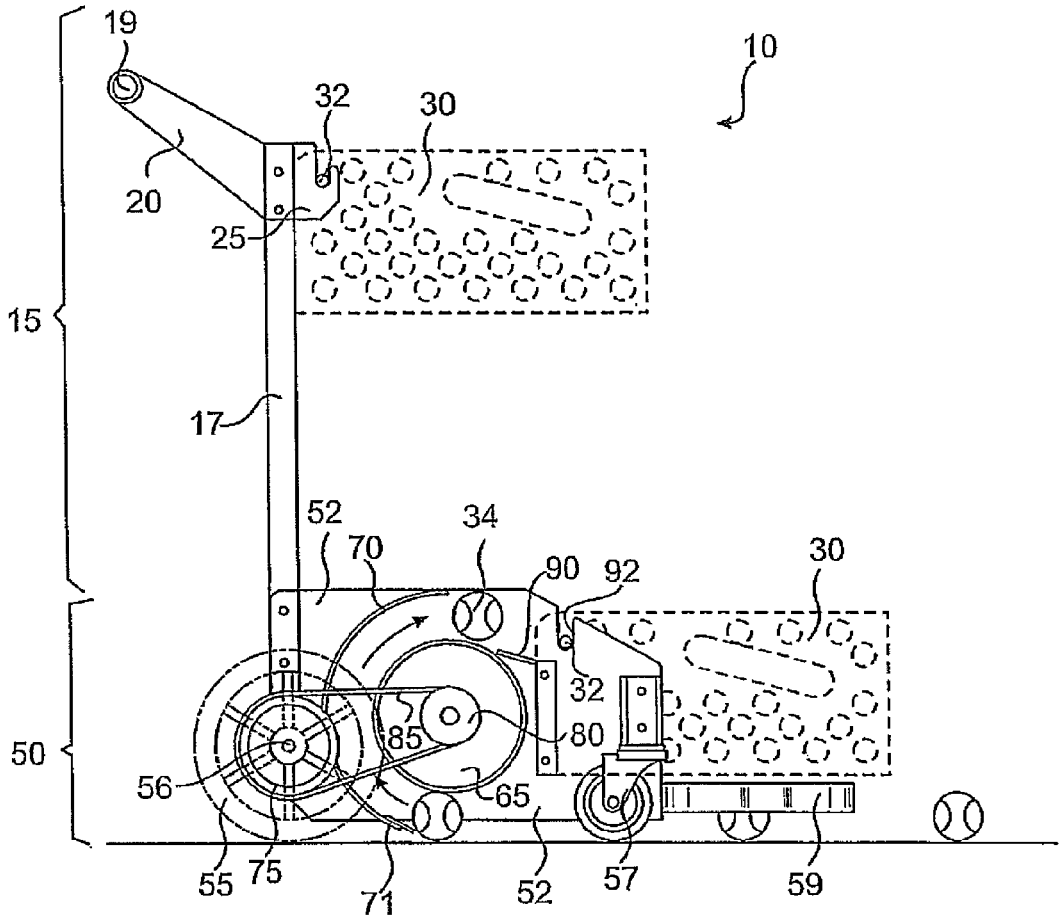
FIG. 2 is a right side elevation view of the ball collection device shown in FIG. 1 where the rear wheel is shown in broken lines.

Turning to FIG. 2, there is special emphasis on the pulley wheels 75 and 80. Specifically, as shown the rear pulley wheel 75 is approximately 2.5 times larger in circumference than pulley wheel 80. Alternatively, the differential may be 2.5 to 3 times, or in another example, about 2 to 4 times. In any event, the circumference of the rear pulley wheel 75 is larger than the circumference of the forward pulley wheel 80 so that the drum 65 will rotate more rapidly than the rotation of the rear wheel 55.

FIG. 2 is also a very clear view demonstrating the operation of the pick-up device 10. As shown, a tennis ball 34 passes underneath the ball basket 30 and underneath the rotating drum 65. It is then contacted with and raised up by the front or leading edge 71 of the drum rail 70. By the friction contact of the ball 34 with the drum rail 70 and the spinning drum 65, the ball travels around the path shown to the top of the drum 65. There, a guide ramp 90 directs the tennis balls 34 into the ball basket 30.

Figure 3B:
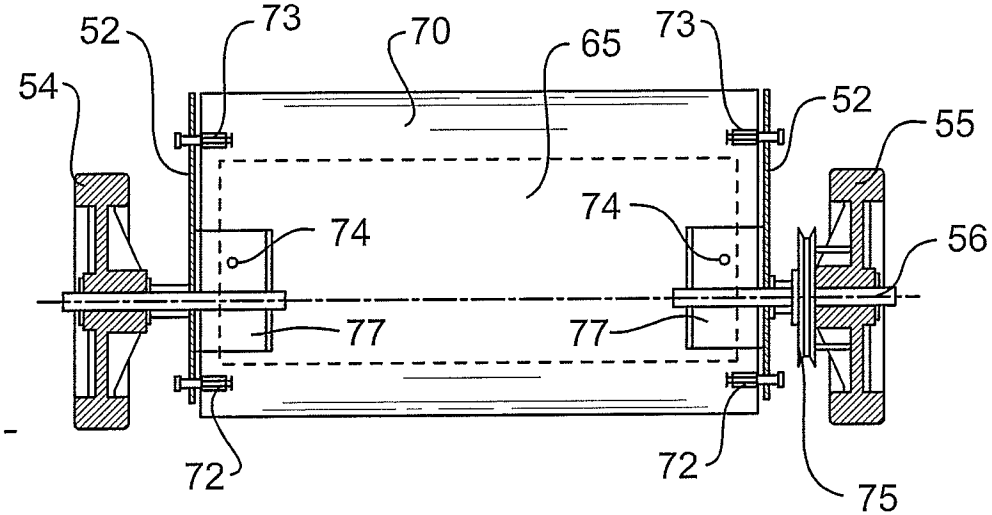
FIG. 3B is a rear view of the cart portion of the ball collection device.
Figure 3A:
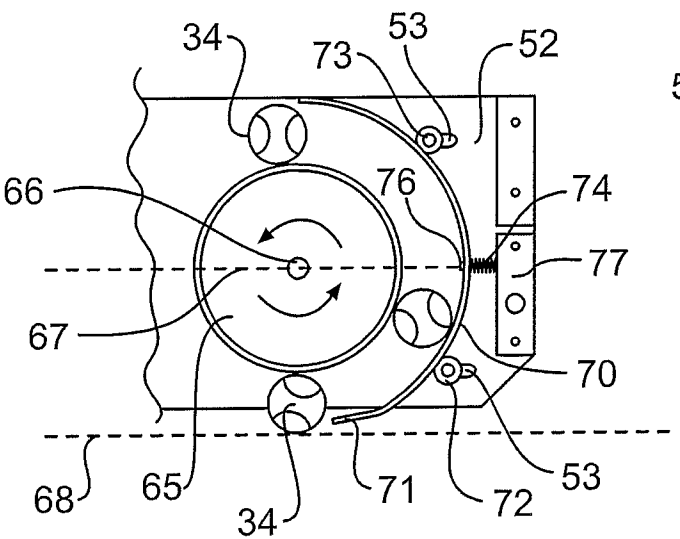
FIG. 3A is a left side cross-sectional view of the ball collection device.

FIG. 3A emphasizes the rotation of the drum 65, in this figure, traveling in the direction right to left. As shown, the leading edge 71 of the drum rail 70 lifts the tennis balls 34. The drum rail 70 is mounted with two pins 72 and 73 at each end or side of the drum rail 70. These pins 72 and 73 are carried in horizontally oriented slots 53 in the side brackets 52. The horizontal slots 53 allow the drum rail 70 to move forward and back in the horizontal direction. The spring 74 is guided by a stand-off spacer 76 that is bolted to the support bracket 77. The end of the stand-off spacer 76 goes through a hole in the drum rail 70. The springs 74 are freely compressed between the drum rail 70 and support bracket 77. This spring 74 biases the drum rail 70 to the forward rest position where the drum rail is generally evenly spaced from the rotating drum around approximately 180° of the circumference around the drum 65. The spring 74 is biased forward, but it allows the movement, in FIG. 3A in the horizontal direction backwards or to the right. In this way, the tennis balls 34 that may be picked up on the drum rail 70 will not be bound up next to each other and cause the drum 65 to jam. Instead, short movement of the drum rail 70 allows the balls 34 to become disentangled and travel as intended around the drum 65. The spring 74 is mounted along a hypothetical line that is horizontal to the axis 66 of the drum 65. This horizontal line 67 is substantially parallel to the line 68 that is the surface or ground on which the pick-up device 10 will travel.

FIG. 3B is a rear view of the base portion 50 with all of the handle portion 15 removed for clarity of the drawing. The wheels 54 and 55 are shown in cross section on either side. Mounted on the same axis 56 as wheel 55 is the pulley wheel 75. Each of the wheels 54 and 55 is mounted on the rear support brackets 77. The drum rail 70 is shown with its four pins 72 and 73. The pins 73 are mounted on the upper curve of the drum rail 70. The pins 72 are mounted on the lower portion of the curve of the drum rail 70. The pins are mounted in and allowed to move back and forth within slots 53 in the side wall brackets 52. The drum 65 is shown in broken lines. Also illustrated are the springs 74 that are fixed on one end by the back support brackets 77 and on the other end by the back of the drum rail 70.

Figure 4:
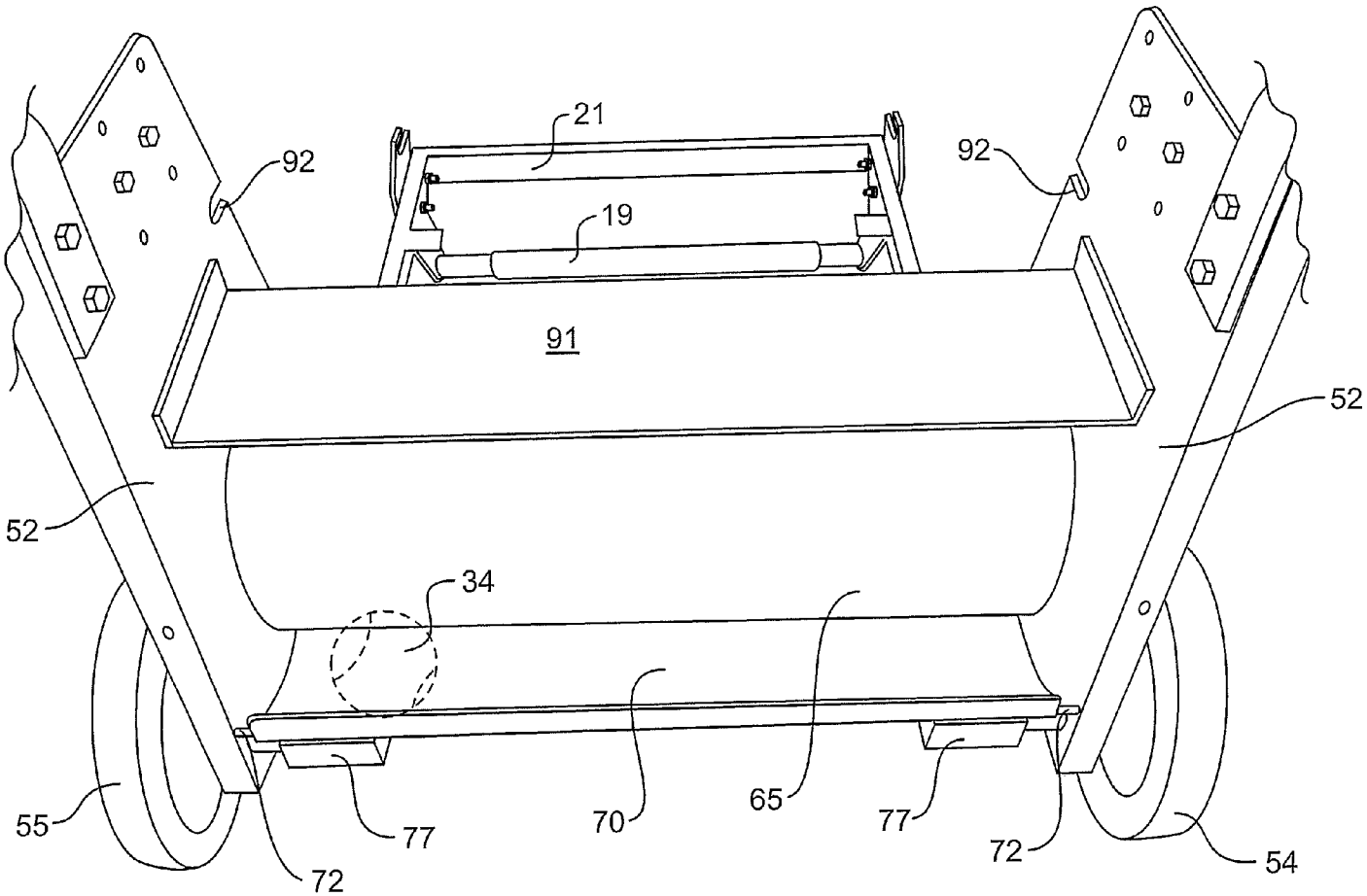
FIG. 4 is a bottom perspective view of the cart shown in FIGS. 1A and 1B without any ball basket mounted on the device.

FIG. 4 is a view of the base section 50 as seen in a perspective view from the bottom. The side wall brackets 52 carry the drum rail 70 by way of support pins 72. (Support pins 73 are not shown as they are behind the drum 65.) The wheels 54 and 55 of the cart are shown mounted on either side of the base portion 50. Also evident are the notches 92 that carry the ball basket 30 (not shown). There is a front apron 91 that helps support the ball basket 30 when mounted in the lower collection position. The apron 91 also prevents any inadvertent or undesired contact from the front with the spinning drum 65. Shown in the top of FIG. 4 is the cross bar 21 and handle 19 bar of the handle portion 15 of the present device.

Figure 5:
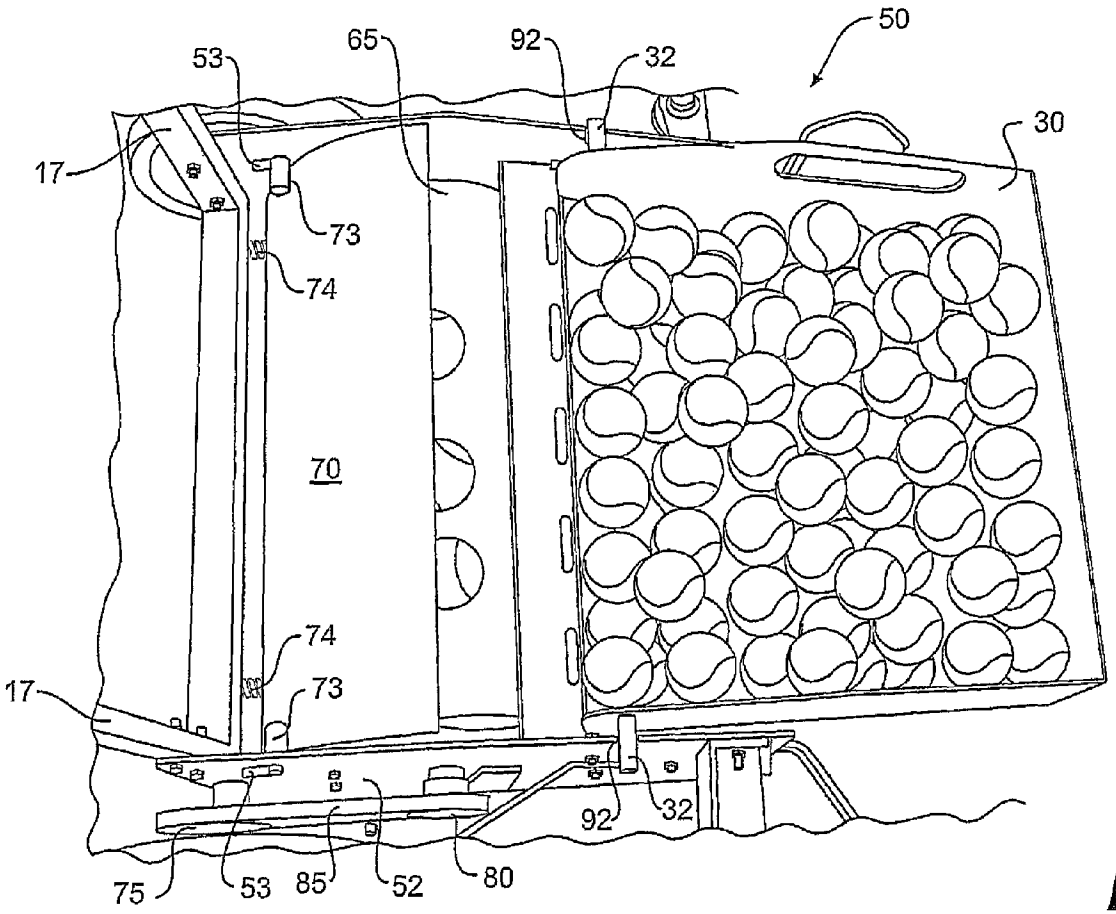
FIG. 5 is a top perspective view of the cart portion of the ball collection device with a ball basket mounted on the cart.

FIG. 5 is a top view of the base portion 50. There is shown the drum rail 70 with its top support pins 73 mounted within the base portion 50 and carried across the width of the base portion 50. Also shown are the springs 74 mounted on the back side of the drum rail 70. The ball basket 30 is shown mounted in the notches 92 by the support pins 32. Also shown are the rear pulley wheel 75 and forward pulley wheel 18 connected by the belt 85 there between.

In the forgoing example, the pulleys 75 and 80 are shown as a means of speeding the rotation of the drum 65. Alternatively, gears could be engineered to interact and obtain the faster rotation of the drum. A gear could be mounted and rotate around the axis on which the rear wheels of the device move. A second, smaller gear could be mounted around the axis of the drum to increase the rotation of the drum. Additionally, a chain and sprocket assembly could be used. Instead of pulley wheels 75 and 80, a large and small sprocket could be substituted and a chain looped around those sprockets to pull or drive the drum 65.

Also, the drawings illustrate specifically the use of springs 74 that bias the drum rail 70 to be forward rest position. Other types of spring materials could be used including rubber mounts or leaf springs or any other elastic material that would bias the drum rail to the forward and rest position but allow movement backwards.

In one example of a collection device, the rear wheels are ten inches in diameter. The rear pulley wheel has a diameter of 5.5 inches. The forward pulley wheel has a diameter of 3 inches. The rotating drum has a diameter of 8 inches and is 20 inches across the width of the cart. The drum has a smooth aluminum surface. The drum rail is a curved sheet of ⅛ inch thick aluminum having a circular curvature with an inside radius of 6.5 inches. The inside surface of the drum rail is smooth aluminum.

Of course there are variations to the structure that can be engineered accordingly to the teachings herein. The foregoing is merely one example of an effective device.

Other embodiments of the present invention will be apparent to those skilled in the art from consideration of the specification. It is intended that the specification and Figures be considered as exemplary only, with a true scope and spirit of the invention being indicated by the following claims.

The invention claimed is:

1. A tennis ball collection device comprising a cart, a ball pick-up assembly, and a ball basket;

the cart comprising a wheeled base having a pair of fixed rotation rear wheels connected to the base and a pair of front swivel wheels connected to the base;

the cart further comprising a handle rigidly connected to the base and extending upwardly therefrom;

the ball basket comprises connector pins that are receivable in a plurality of hooks on the front of the cart base and on the cart handle for removably mounting the ball basket on the base or on the handle;

the ball pick-up assembly being positioned in the base of the cart, wherein the ball pick-up assembly comprises a rotating drum and a drum rail, wherein the drum is a cylinder mounted at each cylinder end across a width of the base and is rotatably connected about an axis to opposite sides of the base;

wherein one end of the drum comprises a first pulley wheel fixed to the drum rotation axis, and a second pulley wheel is connected to one of the fixed rotation rear wheels, and a belt is mounted on the first and second pulley wheels, and the first pulley wheel has a smaller circumference than the second pulley wheel;

the drum rail comprising a curved plate that is mounted on the base, the curvature of the rail being generally evenly spaced from and substantially corresponding to the curvature of the outside circumference of the drum;

the base further comprising a guide ramp from the drum to the front of the base; and the device further comprising a first spring connected on one end to the base of the cart and on the other end to the back of the drum rail, wherein the drum rail is slidably connected to the base, and the spring biases the drum rail to a rest position where the drum rail is generally evenly spaced from the outside circumference of the drum.

2. A tennis ball collection device according to claim 1, wherein the base comprises a pair of opposite side brackets, further wherein the rear wheels are rotatably mounted to each of the side brackets, the cylindrical drum is rotatably mounted on each end to the side brackets, and the drum rail is mounted on each end to the side brackets;

further wherein the side brackets have corresponding slots therein, and the drum rail is slidably mounted to the side brackets in the corresponding slots.

3. A tennis ball collection device according to claim 1, wherein the spring is mounted to the base and to the back of the drum rail and on a line that passes substantially through the horizontal center of the drum and the horizontal center of the curvature of the drum rail.

4. A tennis ball collection device according to claim 1, wherein the distance between the outside circumference of the drum and the inside circumference of the curve of the drum rail when in the rest position is about 2.5 inches.

5. A tennis ball collection device according to claim 1, wherein the slots have a generally horizontal length, and the length is about one inch, whereby the drum rail is allowed to slide back and forth in the horizontal direction from the drum, but the rail is biased to the rest position closest to the outside circumference of the drum.

6. A tennis ball collection device according to claim 1, wherein the outside circumference of the second pulley is about 2 to 4 times the outside circumference of the first pulley.

7. A tennis ball collection device according to claim 1, wherein the outside circumference of the second pulley is about 2.5 to 3 times the outside circumference of the first pulley.

8. A tennis ball collection device according to claim 1, further comprising a second spring connected on one end to the base of the cart and on its other end to the back of the drum rail, wherein the first and second springs are mounted toward opposite ends of the drum rail.

9. A tennis ball collection device comprising a cart, a ball pick-up assembly, and a ball basket;

the cart comprising a wheeled base having a pair of fixed rotation rear wheels connected to the base and a pair of front swivel wheels connected to the base;

the cart further comprising a handle rigidly connected to the base and extending upwardly therefrom;

the ball basket comprises connector pins that are receivable in a plurality of hooks on the front of the cart base and on the cart handle for removably mounting the ball basket on the base or on the handle;

the ball pick-up assembly being positioned in the base of the cart, wherein the ball pick-up assembly comprises a rotating drum and a drum rail, wherein the drum is a cylinder mounted at each cylinder end across a width of the base and is rotatably connected about an axis to opposite sides of the base;

the drum rail comprising a curved plate that is mounted on the base, a first spring mounted between on one end the base of the cart and on the other end the back of the drum rail, wherein the drum rail is slidably connected to the base, and the spring biases the drum rail to a rest position where the drum rail is generally evenly spaced from the outside circumference of the drum;

the base further comprising a guide ramp from the drum to the front of the base.

10. A tennis ball collection device according to claim 9, wherein one end of the drum comprises a first pulley wheel fixed to the drum rotation axis, and a second pulley wheel is connected to one of the fixed rotation rear wheels, and a belt is connected to the first and second pulley wheels, and the first pulley wheel has a smaller circumference than the second pulley wheel.

11. A tennis ball collection device according to claim 9, wherein the base comprises a pair of opposite side brackets, further wherein the rear wheels are rotatably mounted to each of the side brackets, the cylindrical drum is rotatably mounted on each end to the side brackets, and the drum rail is mounted on each end to the side brackets;

further wherein the side brackets have corresponding slots therein, and the drum rail is slidably mounted to the side brackets in the corresponding slots.

12. A tennis ball collection device according to claim 9, wherein the spring is mounted between the base and the back of the drum rail and on a line that passes substantially through the horizontal center of the drum and the horizontal center of the curvature of the drum rail.

13. A tennis ball collection device according to claim 9, wherein the distance between the outside circumference of the drum and the inside circumference of the curve of the drum rail when in the rest position is about 2.5 inches.

14. A tennis ball collection device according to claim 11, wherein the slots have a generally horizontal length, and the length is about one inch, whereby the drum rail is allowed to slide back and forth in the horizontal direction from the drum, but the rail is biased to the rest position closest to the outside circumference of the drum.

15. A tennis ball collection device according to claim 9, further comprising a second spring mounted between on one end the base of the cart and on its other end the back of the drum rail, wherein the first and second compression springs are mounted toward opposite ends of the drum rail.

* * * * *